US009320399B2

(12) United States Patent
Ventress et al.

(10) Patent No.: US 9,320,399 B2
(45) Date of Patent: Apr. 26, 2016

(54) AGITATOR FOR A SURFACE TREATING APPLIANCE

(71) Applicant: Dyson Technology Limited, Wiltshire (GB)

(72) Inventors: Sean Ventress, Bristol (GB); Matthew Adam Tucker, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 14/158,316

(22) Filed: Jan. 17, 2014

(65) Prior Publication Data

US 2014/0196236 A1 Jul. 17, 2014

(30) Foreign Application Priority Data

Jan. 17, 2013 (GB) ..... 1300647.9

(51) Int. Cl.

| | |
|---|---|
| ***A47L 9/04*** | (2006.01) |
| ***A46B 13/00*** | (2006.01) |
| ***A46B 3/16*** | (2006.01) |
| ***A46B 7/04*** | (2006.01) |
| ***A46B 9/02*** | (2006.01) |

(Continued)

(52) U.S. Cl.

CPC ..... *A47L 9/0477* (2013.01); *A46B 3/16* (2013.01); *A46B 7/044* (2013.01); *A46B 9/026* (2013.01); *A46B 13/005* (2013.01); *A46B 13/006* (2013.01); *A46B 3/02* (2013.01); *A46B 3/06* (2013.01); *A46B 2200/30* (2013.01); *A46D 9/02* (2013.01)

(58) Field of Classification Search

CPC ... A47L 15/30; A47L 19/0477; A47L 9/0477; A47L 9/0461; A46B 13/001; A46B 13/005; A46B 13/006

USPC ..... 15/179, 182–183

See application file for complete search history.

(56) References Cited

U.S. PATENT DOCUMENTS

| | | | | |
|---|---|---|---|---|
| 3,874,017 | A | 4/1975 | Parker | |
| 4,307,479 | A | 12/1981 | Mertes et al. | |
| 4,372,004 | A * | 2/1983 | Vermillion | 15/182 |
| 2003/0066150 | A1 | 4/2003 | Stegens et al. | |

FOREIGN PATENT DOCUMENTS

| | | |
|---|---|---|
| DE | 33 42 832 | 6/1985 |
| DE | 197 28 380 | 1/1999 |

(Continued)

OTHER PUBLICATIONS

International Search Report and Written Opinion mailed Feb. 24, 2014, directed to International Application No. PCT/GB2014/050068; 10 pages.

(Continued)

*Primary Examiner* — Laura C Guidotti

(74) *Attorney, Agent, or Firm* — Morrison & Foerster LLP

(57) ABSTRACT

An agitator for a surface treating appliance. The agitator comprises an agitator body having an axis, and a bristle strip carried on the agitator body and extending along a central region of the agitator body and an end region of the agitator body. The bristle strip includes a plurality of bristles aligned in a row, and wherein bristles associated with the end region of the agitator extend in a direction that defines an acute angle with the longitudinal axis of the agitator. In this way, the bristles on the ends of the agitator are provided with a outwardly swept configuration that increases the effective swept width of the agitator.

12 Claims, 8 Drawing Sheets

(51) Int. Cl.

| | |
|---|---|
| *A46B 3/02* | (2006.01) |
| *A46B 3/06* | (2006.01) |
| *A46D 9/02* | (2006.01) |

(56) References Cited

FOREIGN PATENT DOCUMENTS

| | | |
|---|---|---|
| GB | 2 409 405 | 6/2005 |
| GB | 2 443 364 | 4/2008 |
| JP | 62-207422 | 9/1987 |
| JP | 63-129555 | 8/1988 |
| JP | 2-167124 | 6/1990 |
| JP | 4-35632 | 2/1992 |
| JP | 2006-174954 | 7/2006 |

OTHER PUBLICATIONS

Search Report dated May 17, 2013, directed to GB Application No. 1300847.9; 1 page.

* cited by examiner

AGITATOR FOR A SURFACE TREATING APPLIANCE

REFERENCE TO RELATED APPLICATION

This application claims priority of United Kingdom Application No. 1300847.9, filed Jan. 17, 2013, the entire contents of which are incorporated herein by reference.

FIELD OF THE INVENTION

The invention relates to an agitator for a surface treating appliance. The invention has particular use in the form of a rotatable agitator for a vacuum cleaner.

BACKGROUND OF THE INVENTION

Surface treating appliances such as floor sweepers and vacuum cleaners may be provided with a cleaner head which includes a rotatable agitator for improving the cleaning performance of the appliance. FIG. 1 shows such a cleaner head by way of an example. The cleaner head 1 comprises a housing 2 in which is mounted an agitator 3, a drive assembly 4 and a control assembly 5.

The agitator 3 comprises an elongate agitator body 6 one end of which is mounted to a bush 8 and seated in a removable cap 9, and the other end of which is mounted to a transmission 11 that forms part of the drive assembly 4. The agitator is therefore journalled between the transmission 11 and the bush 8 so that it can be rotated by the transmission 11. In a known manner the transmission is driven by an electric motor 10.

Referring to the agitator 3 in more detail, the elongate body 6 of the agitator 3 carries a plurality of bristle strips 7. Each bristle strip 7 comprises a ribbon-like carrier to which a plurality of bristles or filaments are attached so as to extend away perpendicularly from the carrier. Note that the individual bristles cannot be seen in FIG. 1. Each of the bristle strips is secured in a track defined by the agitator body 6 in a helical formation. The use of bristle strips in agitators is advantageous since they provide an efficient way to install a relatively dense and uniform row of bristles or filaments to an agitator. This type of agitator may be referred to in the art by various terms; beater bar or brush bar, for example and such terms should be considered synonymous.

The bristle strips extend from one end of the agitator to the other end and terminate at bearing portions. One end of the agitator is shown in detail in FIG. 2 and it can be seen here that the perpendicular bristles do not extend right to the end of the agitator but instead terminate at the bearing portion 6*a*. This configuration leaves a margin at each end of the cleaner head that is not processed by the agitator in use and so dust and debris may remain adhered to the floor surface in these margins. This can be a problem when using the cleaner head to clean up to an edge of a room since dirt may remain in a margin along the edge of the room. As a general principle, therefore, it is desirable to maximize the 'swept width' of an agitator within a cleaner head.

SUMMARY OF THE INVENTION

Against this background the invention provides a rotatable agitator for a surface treating appliance. The agitator comprises an agitator body having an axis, and a bristle strip carried on the agitator body and extending along a central region of the agitator body and an end region of the agitator body. The bristle strip includes a plurality of bristles aligned in a row, and wherein bristles associated with the end region of the agitator extend in a direction that defines an acute angle with the longitudinal axis of the agitator.

In this configuration, the bristles at the end of the bristle strip are provided with a 'outwardly swept' form which increases the swept width of the agitator without increasing the width of the actuator body. This reduces in size the unswept margin that is evident with prior art agitators that use bristle strips as described with reference to FIGS. 1 and 2, for example. Moreover, the increase in swept width is achieved using a standard bristle strip component with bristles that extend substantially perpendicular to a base material or carrier.

Although the bristles associated with the central region of the agitator may extend at different lay angles relative to the axis, it is preferred that they extend in a direction substantially perpendicular to the axis of the agitator.

The agitator may be configured such that a first strip portion of the bristle strip is substantially parallel to the axis and a second strip portion of the bristle strip extends in a direction which converges on the axis. The second strip portion therefore changes the lay direction of the bristles relative to the axis of the agitator, although the lay direction of the bristles relative to the agitator remains the same.

The end region of the agitator may be integral to the central region of the agitator. However, in one embodiment, the end region is provided by an end member securable to the central region of the agitator. Such a configuration may simplify the technique needed to manufacture the agitator. For example, it may be more straightforward to injection mould the agitator out of two or more parts and then to secure these together to form the agitator.

The bristle strips may be coupled to the agitator by various techniques, for example by gluing, by clamping or by welding the bristle strips directly onto the outer surface of the agitator. However, in one embodiment, the agitator is configured so that the bristle strip is received in a track provided on the agitator. This is a convenient configuration since the bristle strips can be slid into the tracks during assembly.

Each track may include a first track portion provided on the central region of the agitator, which may be helical in form, and a second track portion provided on the end member of the agitator, which may be linear in form.

The second track portion on the end member may be provided with at least one inclined portion so that the filaments associated with the inclined portion extend at an acute angle to the agitator axis. Preferably, the end member is provided with two ramped portions side by side, each of the ramped portions having an opposite gradient. In this case, the first inclined portion may be directly adjacent the central region of the agitator main body and wherein the second inclined portion may be directly adjacent the first inclined portion. Preferably the second inclined portion may have a negative gradient such that the outer surface of the agitator narrows or converges towards the agitator axis.

BRIEF DESCRIPTION OF THE DRAWINGS

In order that the invention may be more readily understood, embodiments will now be described by way of example only with reference to the accompanying drawings, in which.

DETAILED DESCRIPTION OF THE INVENTION

Figure 3:
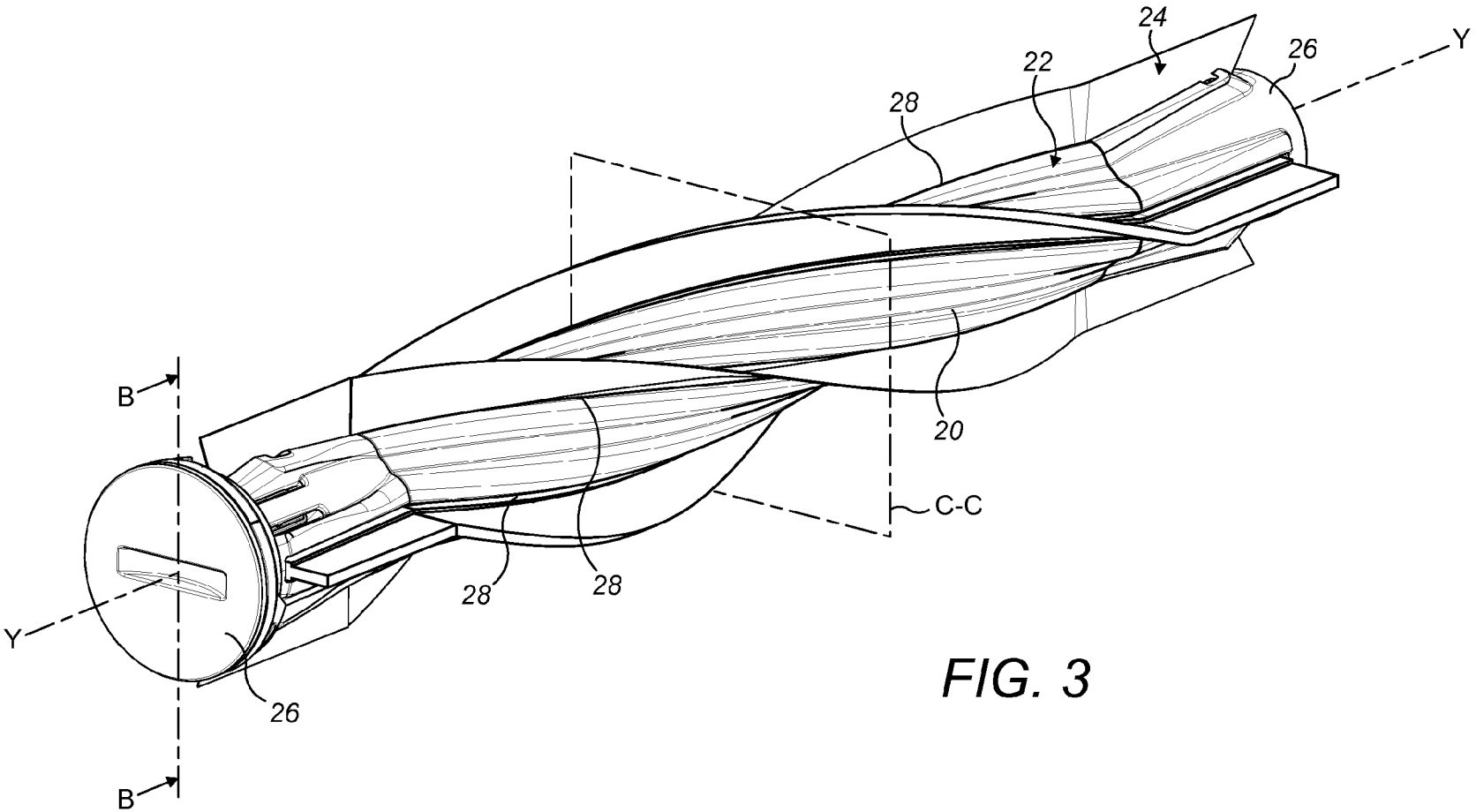
FIG. 3 is a perspective view of an agitator in accordance with an embodiment of the invention.

With reference to FIG. 3, an agitator 20 in accordance with the invention includes an agitator main body 22 that is elongate in form and has an axis Y. The agitator main body 22 carries several strips of bristles, hereinafter bristle strips 24, which extend along the outer surface of the agitator main body 22 in a generally helical path. In this specific embodiment, the agitator main body 22 carries four bristle strips 24 that are spaced circumferentially at ninety degree intervals although it should be appreciated that the agitator 20 may carry more or fewer bristles strips as required. Also, a uniform spacing is not essential and the bristle strips 24 may be unevenly spaced about the outer surface of the agitator 20 if required.

Figure 1:
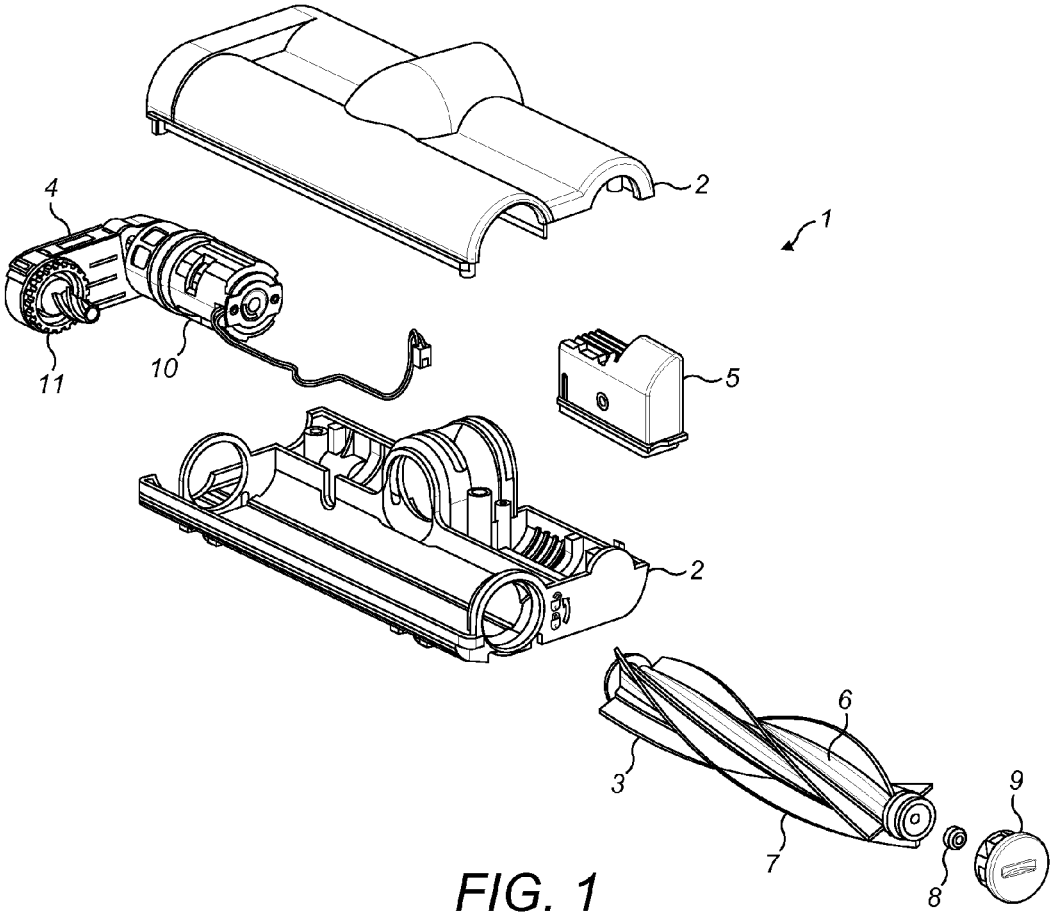
FIG. 1 (PRIOR ART)
FIG. 1 is an exploded view of a cleaner head comprising an agitator exemplifying the prior art.
Figure 2:
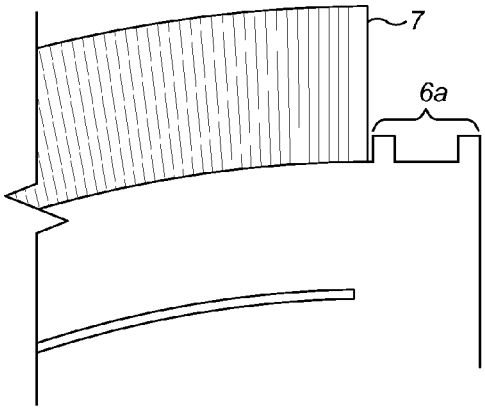
FIG. 2 (PRIOR ART)
FIG. 2 is an enlarged view of an end region of the agitator in FIG. 1.

An end cap assembly 26 is supported on an end of the agitator 20 in a manner similar to that of the agitator 3 in FIG. 1. The end cap 26 provides a means of enclosing the agitator 20 within a suitable chamber in a cleaner head and supporting the agitator for rotation in the manner of the known agitator in FIG. 1.

Each of the bristle strips 24 is received by and held in a respective track 28 defined by the agitator main body 22. Four such tracks are provided corresponding to a respective one of the bristle strips 24. Each track 28 extends from one end of the agitator to its other end. In this embodiment, the agitator is formed from a polymeric material since it provides the necessary strength, lightness and cost-effectiveness desired in such a component although the skilled person would appreciate that non-polymeric materials are also feasible. Specifically, the agitator 20 is formed from acrylonitrile butadiene styrene (ABS) which is injection moulded to the desired form.

Figure 4:
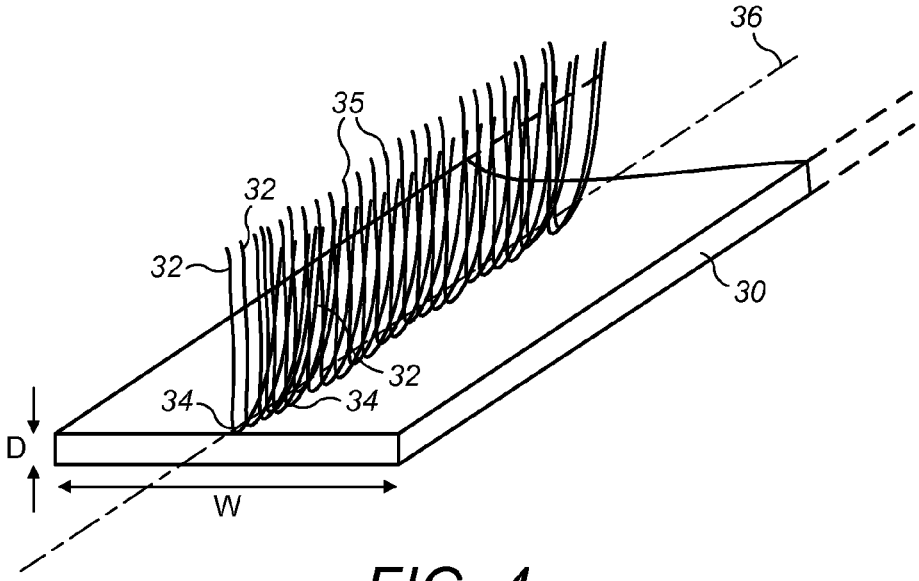
FIG. 4 is enlarged perspective view of one example of a suitable bristle strip that may be used in the agitator of FIG. 3.

An exemplary bristle strip 24 is shown in FIG. 4 and comprises a base 30 and a plurality of bristles 32 attached to the base 30 at a root 34 such that bristle tips 35 are distal from the base 30. Note that, for clarity, not all of the bristles are labeled. Such a bristle strip is known in the art and is available, for example, from Nippon Seal Co. under the material designation PHA-78T34-1. The base is a ribbon-like strip of woven polymeric material, for example polyester, nylon or polyethylene terephthalate (PET), which in this embodiment has a width W of approximately 4 mm and a depth D of approximately 0.5 mm, although it should be appreciated that these dimensions are only illustrative and are not intended to be limiting.

The bristles 32 comprise monofilament thread, strands or filaments having a thickness of approximately 0.1 to 0.2 mm, preferably 0.16 mm, although it should be noted that this dimension is also exemplary and other thicknesses are acceptable. Each of the filaments is stitched to the base along a stitch line, indicated as 36 so that they are aligned in a continuous longitudinal configuration to provide a row of bristles. In this embodiment the stitch line 36 is linear. The filaments are stitched to the base 30 at their midpoints so each filament in effect provides two bristles 32. Two rows of stitching may be provided which would provide the bristles with a more upright orientation. In FIG. 4, for clarity of illustration the bristles are depicted as being relatively sparse, although it should be appreciated that in a practical example the base 30 would be populated with a much higher density of filaments; for example it is preferred that there are between about 130 and 140 filaments per 10 mm base length. Such a density provides a relatively dense curtain of bristles. As an alternative to the bristles being spaced evenly along the stitch line, it should be appreciated that the filaments could be arranged in bundles or tufts of filaments, for example between three and ten filaments to a bundle, and then stitched to the base bundle by bundle.

Figure 5:
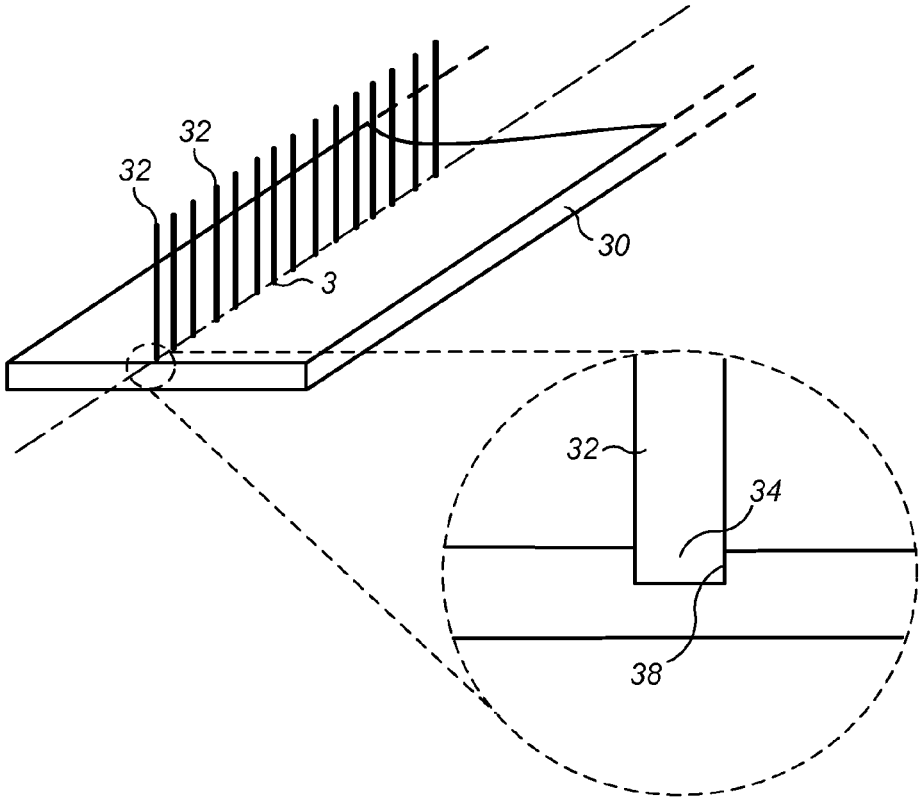
FIG. 5 is an enlarged perspective view of another example of a suitable bristle strip.
Figure 6:
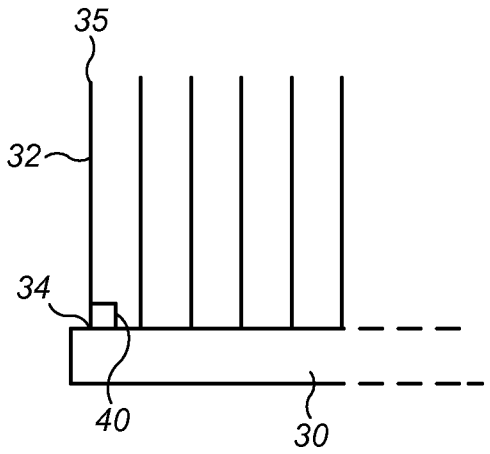
FIG. 6 is a simplified side view of a suitable bristle strip showing a lay angle of individual bristles.

As alternative to stitching lengths of filament to a base material, other methods of constructing bristle strips are known. An example of this is shown in FIG. 5 in which single filaments 32 have roots 34 which are embedded to recesses 38 formed in the base 30. The roots 34 may be retained by suitable binding techniques such as gluing, clamping or welding. In both of the bristle strips 24 shown in FIGS. 4 and 5, the bristles 32 extend away from the base 30 nominally perpendicularly to the base 30, although some departure from the vertical is expected in practice. FIG. 6 illustrates this by depicting the bristle strip from a side elevation where it can be seen that the 'lay angle' 40 of each bristle is approximately ninety degrees.

Although the individual bristles are shown in FIGS. 4, 5 and 6, it should be noted that in other FIG. 3 and FIGS. 8 to 10 the individual bristles are not shown and instead the bristle strips are depicted as solid units for clarity.

Figure 7:
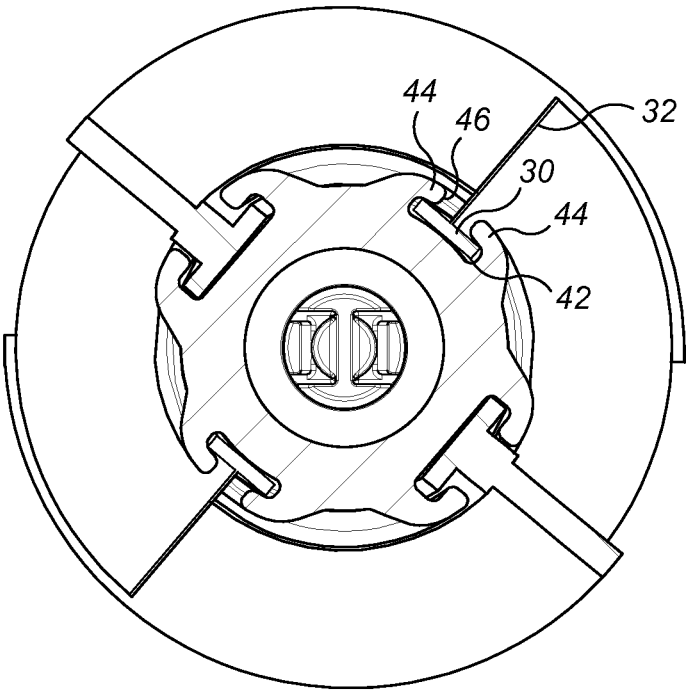
FIG. 7 is a lateral section through the agitator taken along plane C-C in FIG. 3.

FIG. 7 shows the means by which the bristle strips 24 are secured within a respective track 28. Each track 28 is provided by a longitudinally extending channel 42 that is defined in the outer surface of the agitator 20. Each channel has a width comparable to that of the base 30 of the bristle strips and includes two side walls 44 that arch over the channel to define a narrow slot 46 through which extends the row of bristles 32. The base 30 is therefore secured in to the channel 42 by the overarching side walls. During manufacture, the bristle strips 24 are slid into the tracks into the desired positions and then suitably clamped into place, for example by gluing or by way of a suitable mechanical fastener. The channel configuration just described represents one technique by which bristle strips 24 may be provided on an agitator 20. Other techniques are feasible, for example the bristle strips may be clamped between opposed bars, or may be bonded to an external surface of the agitator, by gluing or sonic welding for instance.

Figure 8:
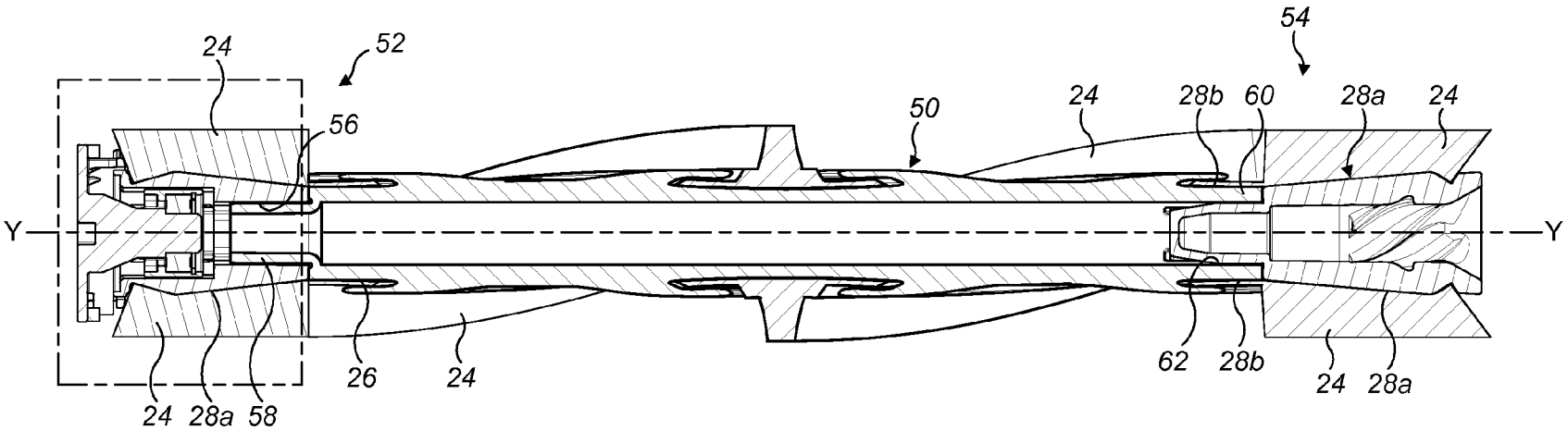
FIG. 8 is a longitudinal section taken along the line B-B in FIG. 3.
Figure 9:
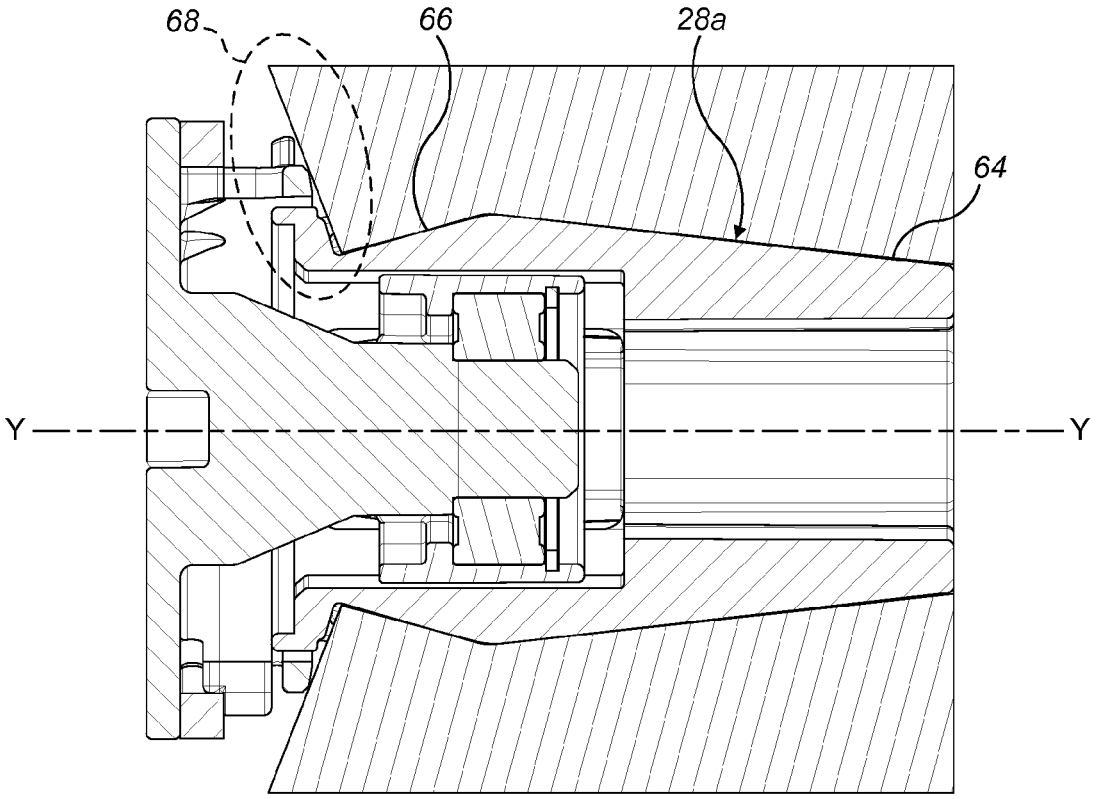
FIG. 9 is an enlarged view of an end region of the agitator in FIG. 8.

Turning to FIGS. 8 and 9, it can be seen that the ends of two of the bristle strips 24 are effectively angled outwardly in the direction of the axis Y. Expressed another way, the ends of the bristle strips 24 feature an 'outward sweep'. This increases the swept width of the agitator 20 of the invention when compared to the agitator of the prior art whilst still using a 'standard' bristle strip having a perpendicular lay angle. An example of an agitator configuration to achieve this effect will now be described further.

For the purposes of this description, the agitator main body 22 can be considered to include a central region that is illustrated generally by the reference numeral 50 and first and second end regions that are illustrated generally by the reference numerals 52 and 54, respectively. In this embodiment, the central region 50 and the end regions 52, 54 of the agitator main body 22 are separate members so that the end regions 52, 54 are connectable to each end of the central region 50.

The first end region 52, as is shown on the left hand side of FIG. 8, includes a socket 56 which is able to mate with a complementary-shaped stub shaft 58 provided on the corresponding end of the central region 50 of the agitator main body 22. Preferably the socket 56 and the stub shaft 58 engage in a press fit, although they can also be secured together by other means such as bonding or ultrasonic welding. A key may be provided to ensure assembly in the correct orientation.

In contrast, the second end region 54, as is shown on the right hand side of FIG. 8, includes a stub shaft 60 that is able to mate with a complementary shaped socket 62 provided in the second end of the central region 50 of the agitator main body 22. Again, the socket 62 and the stub shaft 60 are preferably coupled together by way of a press fit although other means to connect the two components are acceptable.

Each of the end regions 52, 54 includes track sections 28*a* that align with a corresponding track section 28*b* on the central region 50 of the agitator main body 22 so as to result in continuous unbroken tracks 28 that extend from one end of the agitator 20 to the other. It should be noted that the track sections 28*b* on the central region 50 of the agitator 20 are helical in form but define a substantially constant radial distance from the axis Y. In contrast, the track sections 28*a* defined by the end regions 52, 54 are linear but have a radial distance from the axis Y that varies, as will now be explained with specific reference to FIG. 9, which shows an enlarged view of the first end region 52.

The track section 28*a* of the end region 52 includes two adjacent ramped or inclined portions and these are associated with respective first and second strip portions 24*a*, 24*b* of the bristle strip 24. A first inclined portion 64 of the agitator 20 is directly adjacent the central region 50 of the agitator main body 22 and has a positive gradient (approximately 7° slope when referenced to the Y axis) such that the radial distance of the track from the axis Y increases in the direction along the Y axis away from the central region 50 of the agitator 20. The first inclined portion 64 extends for approximately 75% of the length of the end region 52 at which point it transitions into a second inclined portion 66 which has a negative gradient (approximately 15° slope when referenced to the Y axis).

This change in gradient causes the bristles associated in that region to 'splay' outwards so that the bristles on the second strip portion 24*b* and the outermost end 68 of the bristle strip 24 are swept forward from it in the direction of the axis Y thereby increasing the reach of the bristles along axis of the agitator 20. In this particular embodiment, the gradient of the second inclined portion 66 is approximately fifteen degrees when referenced to the Y axis, which results in the bristles defining an angle of approximately seventy-five degrees with the agitator axis Y. A greater degree of slope is acceptable and this would result in an increased 'splay' of the bristles, at the expense of a reduction in bristle density at the point of transition between the first and second inclined portions 64, 66.

Figure 10A:
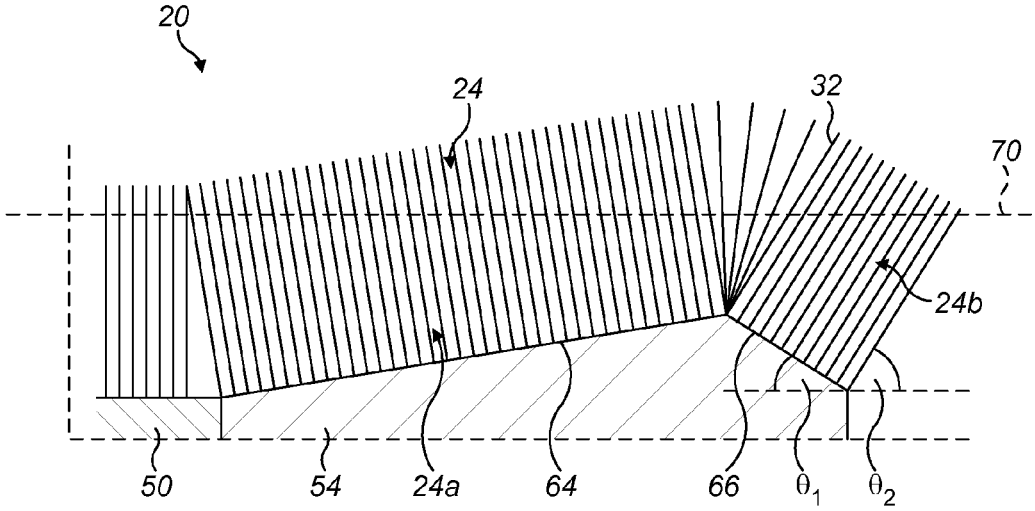
FIGS. 10*a* and 10*b* are simplified section views, similar to that of FIG. 9, that illustrate a manufacturing process for the agitator of the invention.
Figure 10B:
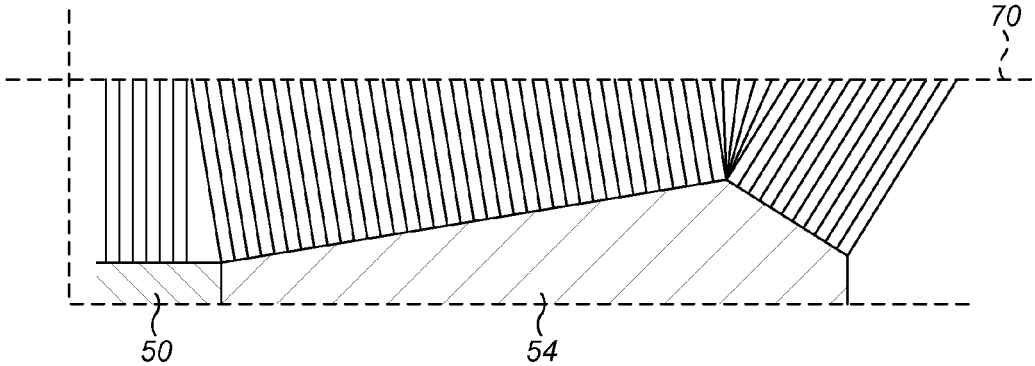

This effect is further illustrated in FIGS. 10*a* and 10*b*. In these Figures, the individual bristles 32 are shown although it should be noted that there are comparatively few bristles shown here for clarity. FIGS. 10*a* and 10*b* also illustrate a manufacturing process by which the bristle strips may be trimmed so to be uniform in height.

FIG. 10*a* shows a bristle strip 24 that has been installed on the agitator 20 and, therefore, the bristle strip 24 extends along the central region 50 of the agitator (shown partially in FIG. 10*a*) and along both the first and second inclined portions 64, 66 of the end region 54. Here it can be seen that the individual bristles 32 in the bristle strip 24 extend perpendicularly to the track 28 along the entire length of the track 28. In the vicinity of the end region 54 the height of the bristle tips 35 increases and decreases with respect to the axis Y in line with the positively and negatively ramped portions 64, 66 of the track 28. As is indicated, the second inclined portion 66 has a gradient $\theta_1$ with respect to the agitator axis Y and the bristles 32 associated with the second inclined portion 66 define an angle $\theta_2$ ($90°-\theta_1$) with the agitator axis Y.

A uniform line of tips 35 of the bristle strip 24 may be created by trimming the tips 35 of the bristles 24 along a straight line, indicated here by dashed line 70. The skilled person would appreciate that such a trimming process could be achieved in many different ways, for example the bristle tips 35 could be manually cut using a pair of scissors, although a preferred method is to rotate the agitator 20 at high speed and bring a sharp blade towards the bristles 32 such that the bristle tips 35 are trimmed to the required length. Such a step could be carried out as part of a partially or fully automated assembly process. FIG. 10*b* illustrates a bristle strip 24 that has been trimmed by the above process.

Some alternatives to the specific embodiment have been mentioned above. Others will now be explained below.

In the above embodiment, the end regions 24 have been described as separate components since this is currently considered to be the most straightforward way to manufacture the agitator in the specific form shown in the drawings using common injection moulding techniques. However, it should be appreciated that the end regions 52, 54 and the central region 30 could alternatively be formed as an integral unit.

The agitator 20 of the invention is designed to be jounaled between its ends and driven about its axis so that it will sweep dirt from a floor covering. For high cleaning efficiency of a cleaner head, it is desirable to maximize the 'swept width' of the agitator and the invention achieves this by configuring the agitator so that the bristle strips have an increased reach at each end of the agitator. However, the invention also envisages agitators of the form described in which only one end of the bristles strips are configured for an increased reach.

Figure 11A:
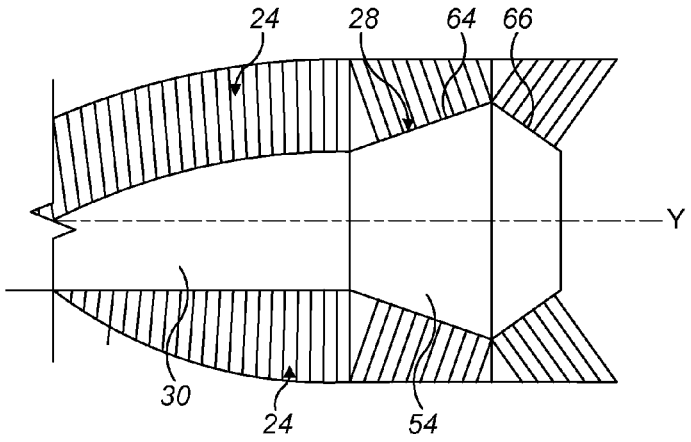
FIG. 11*a* shows a simplified side view of the agitator of the invention for comparison with an alternative embodiments shown in FIG. 11*b* and FIG. 11*c;*
Figure 11B:
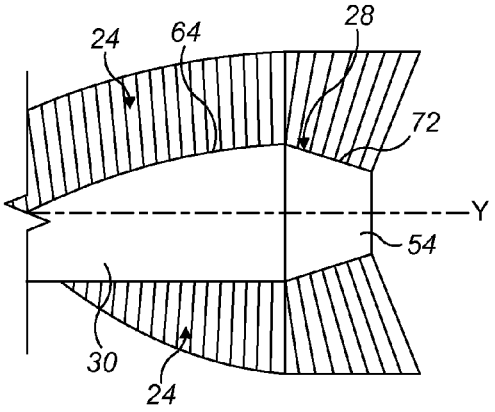

Since the agitator is journaled at its ends, the agitator must have a sufficient diameter to engage with a bearing assembly that supports the agitator in a cleaner head. For this reason, the end regions of the agitator are provided with first and second oppositely ramped portions so that the increasing diameter of the first inclined portion in effect compensates for the reducing diameter of the second inclined portion thereby maintaining a useful diameter at the outer end of the agitator for mounting purposes. However, this is not essential and in a further embodiment, as shown in FIG. 11*b*, the end region 54 is provided with a single inclined portion 72 having a negative gradient so that the radial distance of the track 28 from the axis Y reduces along the axis. Expressed in another way, the diameter of the agitator converges towards the axis Y. When compared to the agitator in FIG. 11*a*, it can be seen that the agitator 20 in FIG. 11*b* has a reduced diameter compared to the agitator 20 in FIG. 11*a* and this may be acceptable in circumstances where the mounting arrangement for the agitator permits a smaller diameter or when the outer end of the agitator is unsupported.

Figure 11C:
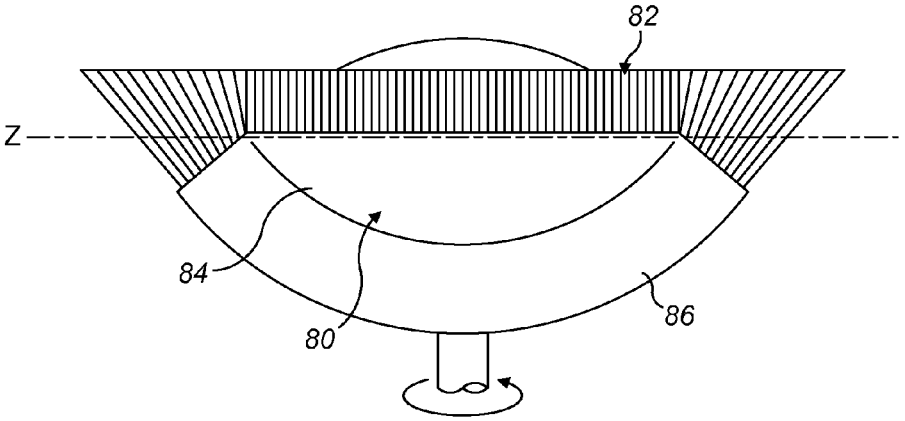

In all of the embodiments described above, the agitator is elongate in form and has a generally cylindrical outer surface. Of course, cylinders with circular, square, triangular or other cross-sections are envisaged. However, a further alternative is a discoidal agitator, as shown in FIG. 11*c*. In this embodiment, an agitator disc 80 has a diametral axis Z along which runs a bristle strip 82. The agitator disc 80 has a substantially flat central region 84 and a downwardly ramped peripheral region 86 that, in this embodiment, encircles the flat central region 84 completely. However, it should be noted that the ramped region 86 may be provided only in the vicinity of the bristle strip 82. As in the embodiments described above, the downwardly ramped region 86 has the effect of splaying the bristle strips outwardly or imparting an 'outward sweep' so that the effective reach of the bristle strip 82 is extended.

A known way of mounting bristle strips onto an agitator is to receive the bristle strip base into a suitably dimensioned track on the agitator surface as described above. However, although this is the currently preferred way of mounting the bristle strip since the strips can simply be slid into the tracks during the assembly process, the skilled person would appreciate that bristle strips can be mounted in alternative configurations. For example, it is conceivable that a similar arrangement could be achieved by bonding or otherwise attaching the bristle strips directly to the outer surface of the agitator. For example, the carrier portion could be glued, stapled or welded to the outer surface of the agitator.

Although the invention has been described with reference to a vacuum cleaner, it should be appreciated that the invention could also be applied to other surface treating appliances that make use of rotatable agitators, such as floor sweepers, floor polishers/waxers and floor washers.

The invention claimed is:

1. A rotatable agitator for a surface treating appliance, the agitator comprising an agitator body having an axis, and a bristle strip carried on the agitator body and extending along a central region of the agitator body and an end region of the agitator body, wherein the bristle strip comprises a plurality of bristles aligned in a row, wherein bristles associated with the end region of the agitator extend in a direction that defines an acute angle with the longitudinal axis of the agitator, and wherein the agitator is configured such that a first strip portion of the bristle strip extends in a direction that is substantially parallel to or diverges outwardly away from the axis and a second strip portion of the bristle strip extends in a direction which converges inwardly on the axis.

2. The agitator of claim 1, wherein bristles associated with the central region of the agitator extend in a direction substantially perpendicular to the axis of the agitator.

3. The agitator of claim 1, wherein the bristle strip comprises a plurality of bristles arranged on a base.

4. The agitator of claim 3, wherein the plurality of bristles extend in a perpendicular direction away from the base.

5. The agitator of claim 1, wherein the end region is provided by an end member securable to the central region of the agitator.

6. The agitator of claim 1, wherein the bristle strip is received in a track provided on the agitator.

7. The agitator of claim 6, wherein the end region is provided by an end member securable to the central region of the agitator, and wherein the track includes a central track section provided on the central region of the agitator and an end track section provided on the end member of the agitator.

8. The agitator of claim 7, wherein the central track section traces a helical path about the central region of the agitator.

9. The agitator of claim 7, wherein the end track section traces a linear path along the end member of the agitator.

10. The agitator of claim 7, wherein end track section is provided with a first inclined portion and a second inclined portion so that the bristles associated with the second track portion extend at an acute angle to the agitator axis.

11. The agitator of claim 10, wherein the first inclined portion is directly adjacent the central region of the agitator main body and wherein the second inclined portion is directly adjacent the first inclined portion.

12. The agitator of claim 10, wherein the first inclined portion has a positive gradient and the second inclined portion has a negative gradient.

* * * * *